United States Patent [19]

Fricke et al.

[11] 4,196,650

[45] Apr. 8, 1980

[54] COMBINED ELECTRONIC-PNEUMATIC MUSICAL INSTRUMENT

[75] Inventors: Jobst Fricke, Cologne; Wolfgang Geiseler, Berlin, both of Fed. Rep. of Germany

[73] Assignee: CMB Colonia Management- und Beratungsgesellschaft mbH. & Co., K.G., Cologne, Fed. Rep. of Germany

[21] Appl. No.: 795,606

[22] Filed: May 10, 1977

[30] Foreign Application Priority Data

May 11, 1976 [DE] Fed. Rep. of Germany ..... 2620843

[51] Int. Cl.[2] ..... G10H 3/00

[52] U.S. Cl. ..... 84/1.1; 84/DIG. 7; 84/DIG. 15

[58] Field of Search ..... 73/213; 235/201 FS; 84/1.1, 376 EA, DIG. 7, 14, 15

[56] References Cited

U.S. PATENT DOCUMENTS

| | | | |
|---|---|---|---|
| 2,773,943 | 12/1956 | Poleshook | 84/DIG. 15 |
| 2,798,397 | 7/1957 | Frigo | 84/DIG. 15 |
| 3,333,468 | 8/1967 | Jacobs | 73/213 |
| 3,402,251 | 9/1968 | Bright | 84/DIG. 15 |
| 3,610,802 | 10/1971 | Berwin | 84/DIG. 14 |
| 3,626,350 | 12/1971 | Suzuki | 84/DIG. 7 |
| 3,686,946 | 8/1972 | Halmi | 73/213 |
| 3,699,492 | 10/1972 | Yoshihara | 84/DIG. 7 |
| 3,939,708 | 2/1976 | Greer | 73/213 |
| 3,943,812 | 3/1976 | Nagai | 84/DIG. 7 |
| 4,044,642 | 8/1977 | Pearlman | 84/DIG. 7 |

*Primary Examiner*—J. V. Truhe
*Assistant Examiner*—Leonard W. Pojunas, Jr.
*Attorney, Agent, or Firm*—Frishauf, Holtz, Goodman & Woodward

[57] ABSTRACT

An acoustic signal generator circuit produces electrical acoustic signals whose frequency spectrum and envelop curve respectively determine the acoustic parameters, pitch and timbre and, respectively, the change in amplitude with time and accordingly the volume, attack and decay phenomena and also quasi stationary behavior of the corresponding sound. There is a manually actuated control device for influencing at least one part of the acoustic parameters. The control device can be constructed in a manner similar to an accordion with a blow bellows and at least one keyboard.

10 Claims, 5 Drawing Figures

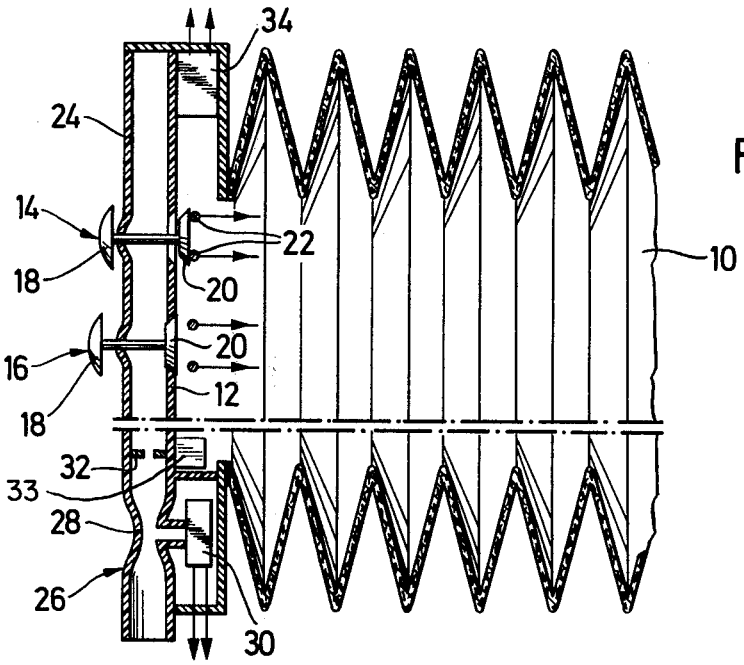
Fig. 1
Fig. 2A
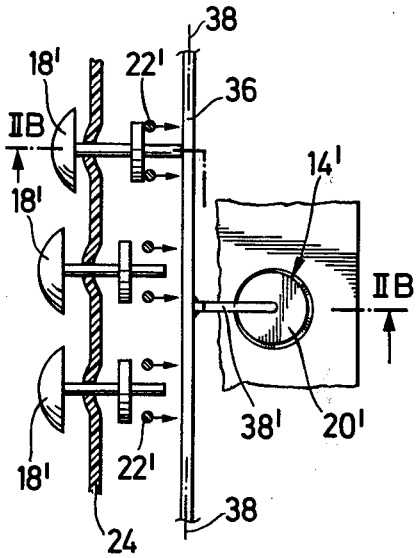
Fig. 2B
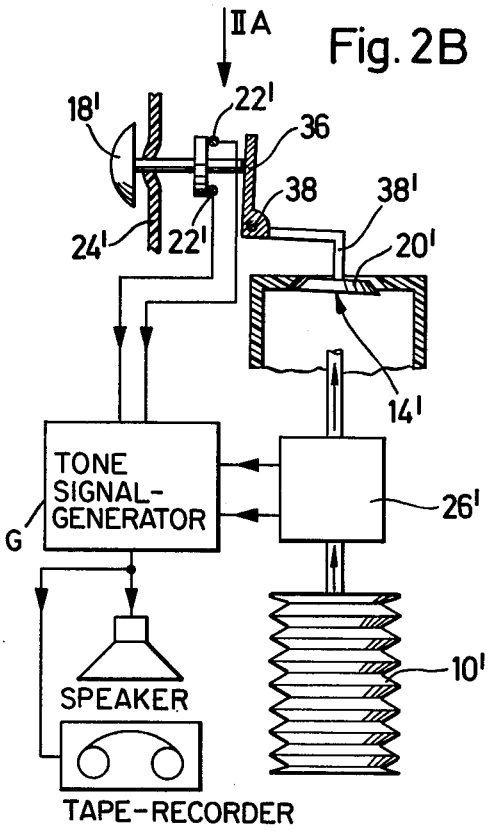
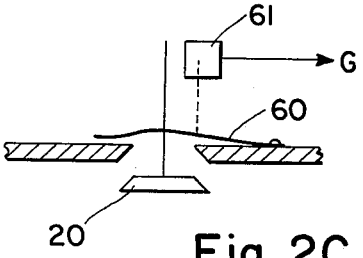
Fig. 2C

COMBINED ELECTRONIC-PNEUMATIC MUSICAL INSTRUMENT

REFERENCES TO APPLICATIONS

P 25 15 524.2 (German)=674,830 (U.S.)
P 25 35 344.0 (German)=712,339 (U.S.)
P 25 35 181.9 (German)=312,080 (U.S.)

BACKGROUND OF THE INVENTION

1. Field to which the invention relates

The present invention relates to an electronic musical instrument with an acoustic signal generator circuit for producing electrical acoustic signals whose frequency spectrum and envelope curve respectively determine the acoustic parameters, pitch and timbre and, respectively, the change in amplitude with time and accordingly the volume, attack and decay phenomena and also quasi stationary behavior (for example vibrator) of the corresponding sound. There is a manually actuated control device for influencing at least one part of the acoustic parameters.

2. Proposals in prior applications

Electronic musical instruments of the above mentioned type are described in U.S. patent applications 674,830 and 712,339. In the case of these previously proposed instruments it is possible to control for example the part, controlling the pitch, of the frequency spectrum by means of a keyboard or other key arrangement and the envelope curve of the acoustic signals can be controlled by a pneumatic-electrical transducer ("blow transducer"), which supplies an output signal which is substantially proportional to the speed of flow of the air current produced by the player. The part, determining the timbre, of the frequency spectrum can be determined by filter circuits and other frequency determining members in the acoustic signal generator circuit and can be varied by a register so that the sounds of various different conventional music instruments can be imitated.

The music instruments proposed in the above mentioned patent applications are played in a manner similar to conventional wind instruments and more particularly reed instruments. Furthermore the U.S. patent application 312,080 describes an electronic musical instrument which can be played in a manner similar to a conventional string instrument with a bow.

SUMMARY OF THE INVENTION

One object to the present invention is to create an electronic equivalent of a further conventional musical instrument.

In order to achieve this object and other objects the invention provides an electronic musical instrument of the initially mentioned type characterised in accordance with the invention that the control device is constructed along the lines of an accordion with a bellows and a keyboard.

The electronic musical instrument in accordance with the invention can be played like an accordion but it offers substantially more possibilities than the latter particularly as regards selecting the timbre.

The term "harmonica" is in the present specification and claims to be understood to mean instruments similar to accordions, harmonicas bandoneons, concertinas or mouth-organs and the like. Certain aspects of the invention are also applicable to other aerophones with bellows as for example instruments like bagpipes and the like and to instrument blown by mouth.

In the case of accordions (and other aerophones using bellows) a player has two possibilities for influencing the produced sound, that is to say determining the pitch by pressing his fingers on keys (or closing note holes) and on the other hand the degree of pressure on the bellows can be used to influence primarily the volume. In the case of the present electronic musical instrument the fingers are used to control an acoustic signal generator circuit with respect to the parts of the frequency spectrum which determine the pitch and the pressure in the bellows and/or the flow, controlled by means of the fingers, of the air from the bellows serves for influencing the envelop curve of the acoustic signal, that is to say more particularly their (mean) amplitude in the main part of the sound which follows attack and ends with decay. Simultaneously by means of the air flow the quasi stationary behavior of the sound in the main part can be controlled, this meaning the production of vibrato, tremolo etc.

DRAWINGS

FIG. 1 shows a considerably simplified sectional view of part of an electronic musical instrument in accordance with a first embodiment of the invention.

FIGS. 2A and 2B show an elevation and plan view of a part of an electronic musical instrument in accordance with a second embodiment of the invention.

FIG. 2C shows another embodiment of a pneumatic transducer arrangement.

DESCRIPTION OF PREFERRED EMBODIMENTS

Figure 3:
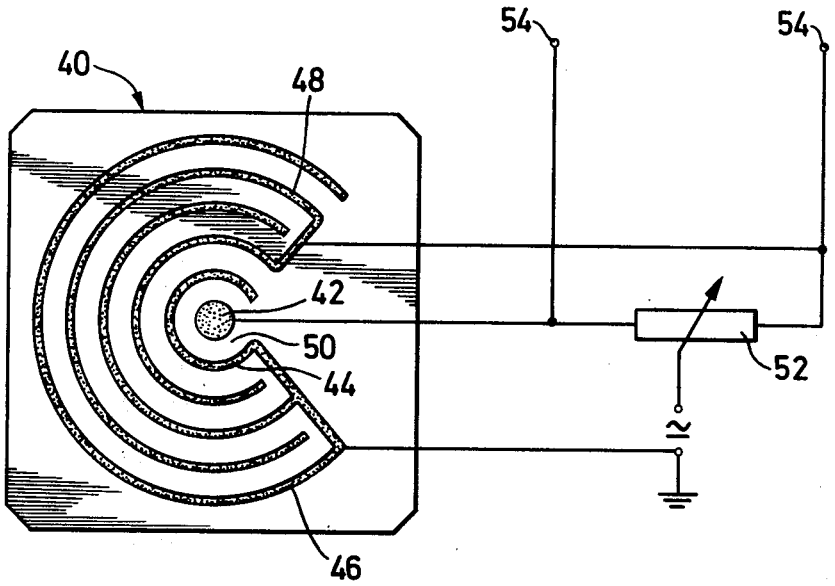
FIG. 3 shows a finger pressure transducer which can be employed in the electronic musical instrument in accordance with the invention.

The electronic musical instrument in accordance with FIG. 1 externally generally resembles the shape of an accordion and comprises accordingly a conventional bellows 10, in whose interior gauge pressure and suction can be produced in a conventional manner.

The interior of the bellows 10 is terminated by a plate 12, which forms the seats for a number of valves, of which in FIG. 1 only two valves 14 and 16 are represented. The valves are respectively adapted to be actuated by a key 18 and comprise a plate-like closing valve member 20, which is simultaneously constructed as a contact bridge and cooperates with two fixed contact pieces 22. The closing valve member is connected with a shank which extends through an external wall 24 to an associated key. To prevent the passage of air between the outer wall 24 and the shank a bellows or other suitable seal is provided.

The space between the valves 12 and 24 is connected via a pneumatic electrical transducer 26 with the atmosphere. The transducer 26 comprises a gradually narrowing and then widening tube 28, from whose narrowest part a branch duct leads to a pressure receiver 30, which provides an electrical output signal, which is proportional to the flow speed and accordingly to the rate of flow of air in the tube 28. Instead of the transducer 26 as described it is also possible to use other flow receiving means as for example flow resistances in conjunction with a differential pressure manometer or pressure gauge and the like.

When the performer depresses a key 18 the associated valve is opened and simultaneously the contact pieces 22 associated with the key are bridged over. It is now possible for air to flow out of the bellows 10 through the open valve into the space between the walls 12 and 24 and out of the latter through the pneumatic-electrical transducer 26. Owing to the bridging over of the contact pieces 22 an acoustic signal is produced in a tone signal generator G (FIG. 2B) with a pitch corresponding to the selected keys, and the envelope curve of this acoustic signal, that is to say its variation with time, is determined by the output signal of the transducer 26. The keys 18 are preferably provided with a mechanical latch so that at any given point in time only one single key can be actuated. If several keys are to be capable of being played simultaneously, a choke 32 can be arranged in the tube 28 and this choke limits the rate of flow through the transducer 26 and the volume information is then preferably obtained in a different manner, for example by means of an electric pressure receiver 34, which responds to the pressure with the bellows 10.

If several keys are to be capable of being simultaneously played, the valves can be so constructed, for example by arranging for the valve members to slide resiliently on the shank, that the valve admittedly opens on depressing the associated key but, however, after a short time it is caused by the resilient action, that is to say the action of a spring, to return to the closed position. The air flow then determines respectively only the attack part of the respective note and the volume or loudness information is preferably attained in another manner. The valve member can in this case naturally not act as a contact bridge and it is therefore necessary to provide a separate contact actuating device.

In the case of the embodiment in accordance with FIG. 2 all keys 18' act on a single valve 14'. The shanks of the keys in this case all act on a single shared plate 36, which is adapted to pivot about an axis 38 and, as shown in FIG. 2B, carries a bent arm 38' with a closing valve member 20'. As is shown diagrammatically in FIG. 2B the flow path between the bellows 10' and the valve 14' comprises a pneumatic electrical transducer 26', which provides an electrical output signal, which is proportional to the rate of flow of the air flowing from the bellows 10' through the transducer 26' and the valve 14'. In the case of this embodiment of the invention the volume information can be derived from the electric output signal of the transducer 26' and connected to tone signal generator G. Furthermore information can be obtained as regards the quasi stationary main part of the sound, while information as regards attack events that is to say the initial part of the respective sound, is clearly only available to a limited extent.

The acoustic signal generator G, which is not shown in detail, is preferably so constructed as described in the U.S. patent application Ser. No. 674,830, that is to say the sounds are represented by acoustic signals in the form of pulse trains, whose cycle duration is inversely proportional to the pitch and whose pulses have a substantially constant duration in the respective pitch range, which has a size of at least one quint and preferably of at least one octave. This constant duration together with the pulse-shape is a function of the frequencies of the minima of the frequency spectrum of the sound to be produced, which preferably has a formant-like character. As a result it is possible to produce a very close imitation of the sounds of classical musical instruments as for example of wood wind instruments, stringed instruments played with a bow and the like. That part of the frequency spectrum which determines the timbre in the acoustic signals is preferably arranged to be set by means of a register control system and can be produced by filters, feedback circuits (see for example U.S. patent application 712,339) and the like in the acoustic signal generator circuit.

The above described embodiments of the invention, in the case of which the air flow produced by the bellows has been employed for influencing the acoustic signals, can also be modified in such a manner that each key is provided with its own valve and its own pneumatic electrical transducer similar to the transducer 26 in FIG. 1. While it is true that this makes the arrangement more complicated, it is possible to ensure that even in the case of chords for each individual the full information as regards the attack and the decay events can be obtained from the air flow controlled by the respective key.

In the case of polyphonic music on the other hand the attack and decay events can also be electronically produced, for example by filter circuits with a suitable attack behavior. In this case for all pitches a common "attack filter" may be employed or for the different pitches or for different pitch ranges different "attack filters" may be used.

In the case of other embodiments of the present harmonica-like electronic musical instrument the acoustic signal generator is not controlled by an air flow produced by a blowing bellows and instead is produced primarily by the actuation of keys. In this case the information with respect to the acoustic parameters must be obtained in a different manner. For this purpose it is possible to use for example an arrangement of the type as represented in FIG. 3.

The arrangement in accordance with FIG. 3 comprises a key part 40 which consists for example of an insulating plate with a conductor arrangement along the lines of a printed circuit. The conductor arrangement comprises a circular first conductor part 42, which with a second annular conductor part 44 forms the electrodes for a first limb of a bridge circuit. The electrodes for a second arm of the bridge circuit are formed by two interfitting electrode sets 46 and 48, which comprise annular sector-like electrodes. When the performer places his fingers on the electrode arrangement he bridges over the intermediate space 50 between the conductor parts 42 and 44 generally completely and accordingly forms a reference re sistance in the first limb of the bridge. The intermediate spaces between the electrode sets 46 and 48 are only partly bridged over, that is to say with a greater or lesser degree of completeness in accordance with the pressure with which the finger is pressed against the key part 40. Between the electrode sets 46 and 48 an electric resistance dependent upon the finger pressure is therefore produced. The remaining two bridge limbs are formed by a potentiometer 52, between whose tapping point and the electrode set 46 connected with ground an input voltage is applied which can be a weak direct or alternating voltage. The output signal is tapped at the other bridge diagonal, that is to say between the conductor part 42 and the electrode set 48 and is available at the output terminals 54. The output signal from the terminals 54 controls on the one hand and preferably via a threshold circuit such as a Schmitt-trigger, the pitch and on the other hand via an analog modulation circuit controls the envelop curve of the acoustic signal produced.

Figure 4:
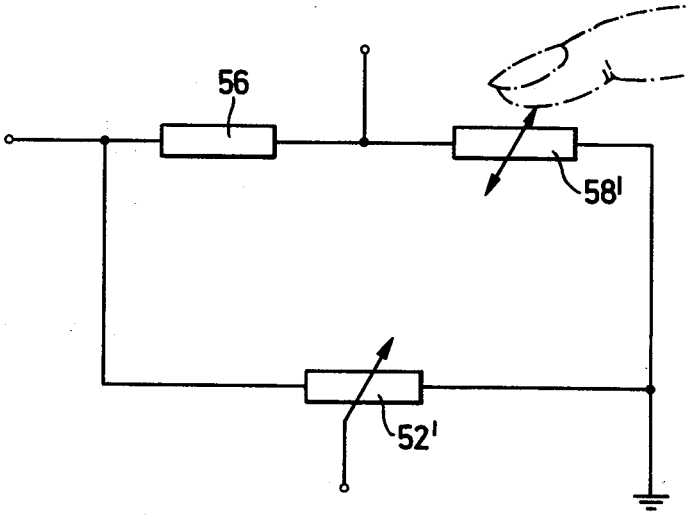
FIG. 4 is a diagrammatic representation of another finger finger pressure transducer for an electronic musical instrument in accordance with the invention.

FIG. 4 diagrammatically shows a simpler key arrangement, which also comprises a bridge circuit. The bridge circuit again comprises a potentiometer 52', a fixed resistor 56 and a resistor 58' which can be changed by digital pressure and can for example be constructed like a carbon granule microphone or can be bridged over by a finger to a greater or lesser extent. Similar key arrangements can also be constructed with piezoelectric elements or the like.

In lieu of controlling the change with time of the acoustic signal by digital pressure on the key determining the pitch, as is made possible with the arrangements in accordance with FIGS. 3 and 4, it is also possible to provide a special key for this purpose.

The quasi stationary course of the acoustic signal can also be determined by low frequency aleatory vibrational phenomena, with which the acoustic signal, for example in the form of a pulse, can be modulated in breadth, height and shape, and by the mixing in high frequency nois fractions.

For influencing the quasi stationary main or centre part of the sound for producing vibrato and dynamic effects it is also possible to provide devices which respond to each other in accordance with the movements of the accordion handles. For this purpose it is possible to provide signal receiving means 3 which operate with magnetic induction, capacitive sensing, the Doppler effect in an ultrasonic transmission path in the bellows or are formed by movement and acceleration sensors, an accelerometer is schematically shown at 33, FIG. 1. The acoustic signal of the respective signal receiver is then used for modulating the sound signal.

The above described arrangements and measures can be provided in addition to the normal sound producing devices of a harmonica or parts of such conventional sound producing means, for example the bass part or the main part. Furthermore, as shown in FIG. 2C, for providing control voltages from the air flow it is possible to make use of the amplitudes of the vibrations of metallic reeds 60 as used in a conventional harmonica by sensing the reed vibrations magnetically or capacitively. A transducer 61 picks up the reed signals. It does not operate quietly when using reed vibrations; on the other hand it is possible in the case of reed vibrations not only to use the amplitude for obtaining the envelop curve information but also the frequency. The raw acoustic signals as taken from the reeds are then additionally electronically processed in generator G that is to say it is possible to use modulation with low frequency aleatory vibrational events and high frequency noise components to provide such acoustic signals with any desired quasi stationary behavior or characteristic.

On the other hand the signals obtained from the reed vibrations can also be used for initiating and synchronizing the acoustic signal produced by means of the acoustic signal generator G, and such acoustic signals then have the same basic frequency as the signal from the reeds and on the other hand it is possible to derive the envelop curve information from the reed vibrations and accordingly control the attack and decay events of the acoustic signal. In this case as well the acoustic signals can be additionally modulated with low frequency aleatory vibrations and noise components with a higher frequency in order to produce a better quasi stationary characteristic. Polyphonic music requires in this respect a corresponding number of acoustic signal generator circuits, which by means of a logical switching network can be coordinated with reeds which are caused to vibrate by actuation of keys.

We claim:

1. A combined electronic-pneumatic musical instrument comprising the combination of an electronic tone signal generator means (G), to provide electrical signals corresponding to acoustic tones whose frequency spectrum respectively determines the acoustic parameters: pitch, and timbre of a selected tone, or tones, for reproduction or storage by an output transducer, and a plurality of operator controllable electrical switch means (14, 18, 22) to selectively control the signal generator to supply output signals to the output transducer corresponding to a selected tone or tones, upon selective operation of at least one of said switch means, with operator controllable pneumatic means (10, 18, 20) coupled to at least two of said electrical switch means, conjointly operated therewith, and furnishing an air flow, and air flow pneumatic-electrical transducer means (26, 28, 30) responsive to said air flow and providing an electrical output signal in response to said air flow, said air flow transducer means being electrically connected to and additionally controlling said tone signal generator to control the envelope curve of said signals and hence the change in amplitude with time, and accordingly the volume, attack, quasi stationary behavior and decay phenomena of the signal corresponding to said selective tone, or tones provided by said signal generator means, in accordance with air flow as controlled by the operator.

2. Instrument in accordance with claim 1, wherein the operator controllable air flow furnishing means are bellows (10) and valve means (20) coupled to said at least two switch means (14, 18, 22) controlling air flow in and out of said bellows upon expansion and contraction of said bellows.

3. An electronic musical instrument in accordance with claim 2, further including a keyboard having keys and individual valves, forming said valve means, and operating elements coupled to the valves, the airflow transducer being positioned in the path of the air current controlled by the valves and supplying an electrical output signal influencing the envelope curve of the acoustic signal produced by said tone signal generator means (G) upon actuation of at least one of said keys.

4. An electronic musical instrument in accordance with claim 2, further including a keyboard having keys, individual switches controlled by said keys and forming said operator controllable switch means for determining the pitch, and a valve operated by at least two keys and forming said valve means, the pneumatic electrical transducer being positioned between the bellows and the atmosphere and supplying an electrical output signal influencing the envelope curve of the acoustic signals produced by said tone signal generator means (G) upon actuation of at least one of the keys.

5. An electronic musical instrument in accordance with claim 2, wherein the transducer means includes a pressure transducer responsive to to air pressure differentials upon operation of the bellows, supplying an electrical output signal controlling the amplitude of the acoustic signal.

6. An electronic musical instrument in accordance with claim 1 including a keyboard having a key arrangement which supplies an electric output signal dependent on operator finger pressure, and coupled to said tone signal generator means (G), for influencing the envelope curve of the acoustic signals.

7. Instrument in accordance with claim 6, wherein the key arrangements respectively comprise a circuit having an exposed electrical resistance path subject to operator finger contact and coupled to the tone signal generator means (G).

8. Instrument in accordance with claim 7, wherein the circuit arrangement comprises a bridge circuit having exposed current paths subject to said bridging-over by the finger of the operator.

9. Instrument according to claim 1, including a keyboard, valves controlled by the keys of the keyboard and forming part of the operator controllable pneumatic means;

metallic reeds (60) controlled by air flow through the valves for excitation thereof; and electrical signal receiver means (61) coupled to the metallic reeds and forming with said reeds said transducer means, to provide an electric signal corresponding to the vibrational amplitude of the respective metallic reed.

10. Instrument in accordance with claim 1, wherein the pneumatic means furnishing an air flow include operator movable bellows;

said instrument further including a motion transducer (33) coupled to the bellows and responding to movement of its ends and forming said air flow pneumatic-electrical transducer means.

* * * * *